US010825588B2

(12) United States Patent
Liu et al.

(10) Patent No.: US 10,825,588 B2
(45) Date of Patent: Nov. 3, 2020

(54) VOLTAGE DIVIDING RESISTOR

(71) Applicants: Chung-Lin Liu, Taoyuan (TW); Chien-Hsin Huang, Taoyuan (TW); Wen-Chung Chen, Taoyuan (TW)

(72) Inventors: Chung-Lin Liu, Taoyuan (TW); Chien-Hsin Huang, Taoyuan (TW); Wen-Chung Chen, Taoyuan (TW)

(73) Assignee: CHROMA ATE INC., Taoyuan (TW)

( * ) Notice: Subject to any disclaimer, the term of this patent is extended or adjusted under 35 U.S.C. 154(b) by 0 days.

(21) Appl. No.: 16/594,073

(22) Filed: Oct. 7, 2019

(65) Prior Publication Data

US 2020/0168371 A1 May 28, 2020

(30) Foreign Application Priority Data

Nov. 26, 2018 (TW) ..... 107142017 A

(51) Int. Cl.
*H01C 1/14* (2006.01)
*H01C 1/084* (2006.01)

(52) U.S. Cl.
CPC ..... *H01C 1/14* (2013.01); *H01C 1/084* (2013.01)

(58) Field of Classification Search
CPC ..... H01C 1/14; H01C 1/084
See application file for complete search history.

(56) References Cited

U.S. PATENT DOCUMENTS 1,396,871 A * 11/1921 Nagel ..... H01C 1/084 338/206
3,788,721 A * 1/1974 Vause ..... H01J 1/22 445/27
4,339,743 A * 7/1982 Ludwig ..... H01C 1/01 29/610.1
4,703,302 A * 10/1987 Hino ..... H01C 1/16 257/E27.047
5,268,651 A * 12/1993 Kerth ..... H01C 7/22 257/E21.004
6,081,183 A * 6/2000 Mading ..... H01C 1/084 338/280
6,181,234 B1 * 1/2001 Szwarc ..... H01C 1/084 338/206
6,570,140 B2 * 5/2003 Karacsony ..... B29C 61/00 219/385
7,057,491 B2 * 6/2006 Dempsey ..... H01C 7/22 257/E27.047

* cited by examiner

*Primary Examiner* — Kyung S Lee

(57) ABSTRACT

Herein disclosed is a voltage dividing resistor comprising a resistance bar and a plurality of dividing connectors. The resistance bar has a first end and a second end and provides a first current path, which stretches from the first end to the second end along the resistance bar. The distance between the first end and the second end is less than the length of the first current path. The first and second ends are configured to be electrically connected to a power source. The dividing connectors are electrically connected to different locations on the first current path. Each of the dividing connectors has a contact pad. The resistance bar is not coplanar with the contact pads. A divided voltage is obtained from a pair of dividing connectors chosen from the plurality of dividing connectors.

11 Claims, 5 Drawing Sheets

VOLTAGE DIVIDING RESISTOR

CROSS REFERENCE TO RELATED APPLICATION

The present application claims priority to Taiwan patent application Serial No. 107142017 filed on Nov. 26, 2018, the entire content of which is incorporated by reference to this application.

BACKGROUND OF THE INVENTION

1. Field of the Invention

The present invention pertains to a resistor, in particular one that has a plurality of contact pads. Selecting different contact pads of the resistor yields a variety of resistance values.

2. Description of the Prior Art

To perform adequate tests on electronic devices of different model numbers and therefore non-identical specifications, engineers adjust settings on their test instruments first. The output voltage signal of a test instrument, for instance, has to fall within a certain range for an electronic device to be able to read. As is common practice, dividing or reducing a larger voltage from a power source may give the requisite voltage signal, albeit often a low-definition one beset by noise. Said practice involves the employment of intricate electronic elements or resistors covering a large area, and is becoming less applicable due to shrinking circuit dimensions.

Consequently, the industry is need of a new kind of resistors that use less space and provide engineers with more options on voltage, so that adequate voltage signals are more conveniently prepared.

SUMMARY OF THE INVENTION

The present invention provides a voltage dividing resistor with a plurality of contact pads. Selecting any two of the contact pads yields a different resistance value and thus helps generating an adequate voltage signal. The voltage dividing resistor also features a three-dimensional structure that takes limited two-dimensional space and contributes to circuit miniaturization.

The present invention discloses a voltage dividing resistor comprising a resistance bar and a plurality of dividing connectors. The resistance bar has a first end and a second end and provides a first current path, which stretches from the first end to the second end along the resistance bar. The distance between the first end and the second end is less than the length of the first current path. The first and second ends are configured to be electrically connected to a power source. The dividing connectors are electrically connected to different locations on the first current path. Each of the dividing connectors has a contact pad. The resistance bar is not coplanar with the contact pads. A divided voltage is obtained from a pair of dividing connectors chosen from the plurality of dividing connectors.

In one embodiment, the chosen pair of dividing connectors forms a second current path, the length of which is less than the length of the first current path. In another, the voltage dividing resistor further comprises a first power connector and a second power connector, which are connected to the first end and the second end, respectively. The power source is electrically connected to the first end and the second end through the first and second power connectors, respectively.

The present invention discloses a voltage dividing resistor comprising M arch structures and N dividing connectors. The M arch structures are arranged in order along a first direction and provide a first current path. The first arch structure and the Mth arch structure are configured to be connected to a power source. The N dividing connectors, each having contact pads, are electrically connected to the M arch structures. The arch structures are not coplanar with the contact pads. A divided voltage is obtained from a pair of dividing connectors chosen from the N dividing connectors. There are a first side and a second side defined with regard to the M arch structures. The mth arch structure connects with the (m−1)th at the first side through a first conducting section, and connects with the (m+1)th at the second side through a second conducting section. M, m, and N are natural numbers, $M>2$, $N>2$, $1<m<M$.

To summarize: The voltage dividing resistor of the present invention comprises a conducting resistance bar that is connected with dividing connectors and may be arranged as a series of arch structures. Engineers can prepare required divided voltages quite easily by connecting to different dividing connectors, whose pairings yield a variety of resistance values.

BRIEF DESCRIPTION OF THE APPENDED DRAWINGS

DETAILED DESCRIPTION OF THE INVENTION

The features, objections, and functions of the present invention are further disclosed below. However, it is only a few of the possible embodiments of the present invention, and the scope of the present invention is not limited thereto; that is, the equivalent changes and modifications done in accordance with the claims of the present invention will remain the subject of the present invention. Without departing from the spirit and scope of the invention, it should be considered as further enablement of the invention.

Figure 1:
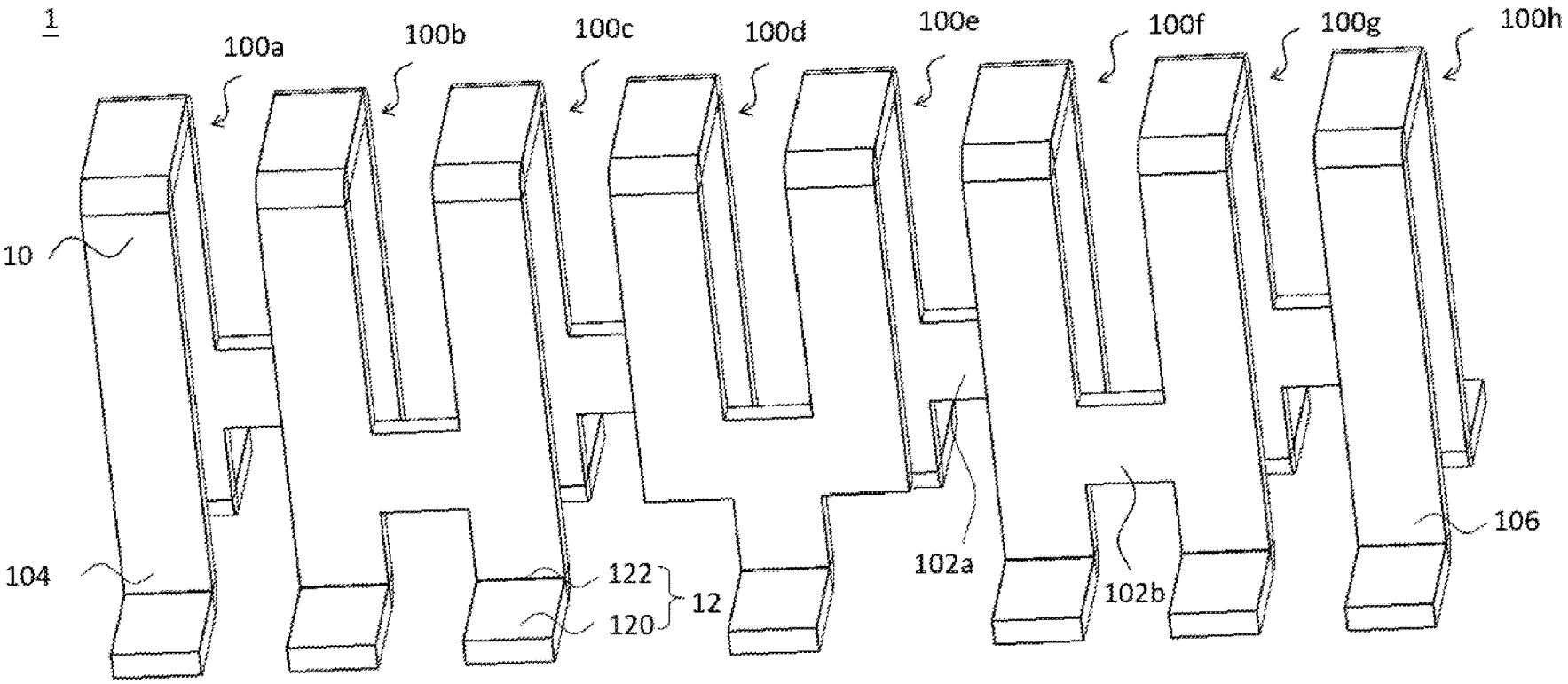
FIG. 1 is a stereogram of a voltage dividing resistor in accordance with an embodiment of the present invention.
Figure 2:
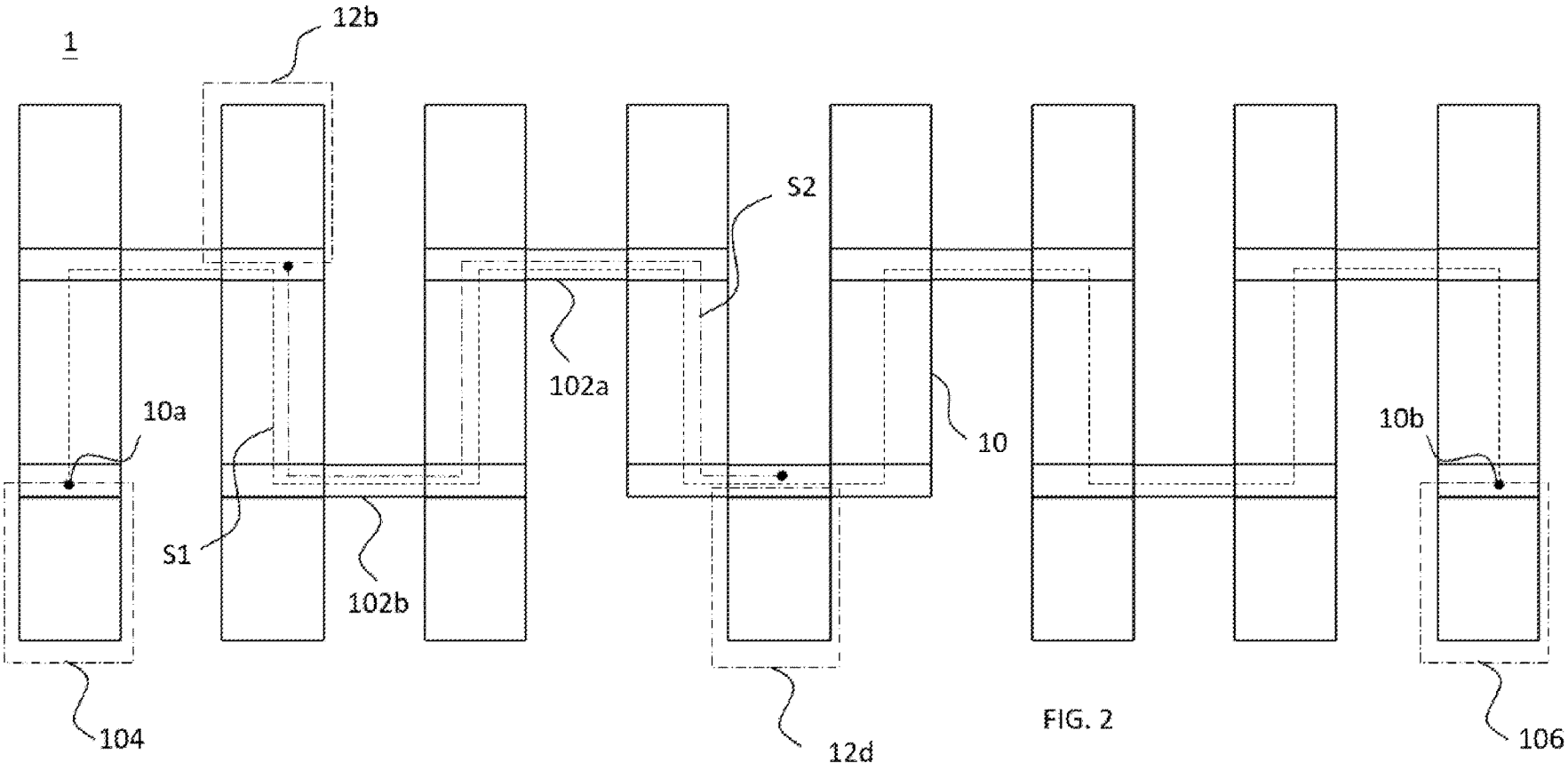
FIG. 2 is a bird's-eye view of a voltage dividing resistor in accordance with an embodiment of the present invention.

Please refer to FIGS. 1 and 2 in conjunction. According to an embodiment of the present invention, FIG. 1 is a stereogram of a voltage dividing resistor 1, and FIG. 2 a bird's-eye view of the same. As depicted in the figures, the voltage dividing resistor 1 comprises a resistance bar 10 and a plurality of dividing connectors 12. The dividing connectors 12 are connected to different locations of the resistance bar 10. The resistance bar 10 and the dividing connectors 12 are made from electrically conducting materials, and may in practice be molded monolithically, e.g. pressed from a single piece of conducting panel and bent to required shapes. Each of the dividing connectors 12 may have a contact pad 120 and a bent portion 122. The exemplary bent portion 122 in FIG. 1 connects the contact pad 120 with the resistance bar 10. In one example, the contact pads 120 of all of the dividing connectors 12 are coplanar, or fitted to the same plane, to make it easy for engineers to make connections thereon, e.g. by wire bonding, drilling, or soldering.

The resistance bar 10 and the plane to which the contact pads 120 are fitted are not of equal elevation; that is, the resistance bar 10 may be a three-dimensional structure that occupies limited two-dimensional space. The resistance bar 10 may further be bent to appear like arch structures. As shown in FIG. 1, arranged from left to right are the interconnected arch structures 100*a* through 100*h* that as a whole form the resistance bar 10. The shapes of and the connections between the resistance bar 10 and the dividing connectors 12 are described below.

Let us define a first side and a second side for the voltage dividing resistor 1. There is also a first current path S1 within the voltage dividing resistor 1 that stretches from a first end 10*a* to a second end 10*b* of the resistance bar 10. Said first side, in the case of FIG. 2 that is a bird's-eye view, may be the side of the voltage dividing resistor 1 which is closer to the top of the figure, and said second side may be that which is closer to the bottom of the figure. The interconnected arch structures 100*a* through 100*h* are held together by conducting sections 102*a* at the first side and conducting sections 102*b* at the second side. To lengthen the first current path S1 as much as possible, both a first-side conducting section 102*a* and a second-side conducting section 102*b* do not connect the same neighboring pair of arch structures, and amongst three consecutive arch structures the two connecting conducting sections do not fall at the same side. Were three consecutive arch structures connected by two conducting sections at the same side, obviously the electric current would take the shortcut and flow through only the conducting sections, rendering the arch structures along its way obsolete and shortening the first current path S1.

In the case of FIG. 2, the first arch structure 100*a* and the second arch structure 100*b* are connected by a conducting section 102*a* at the first side; the second arch structure 100*b* and the third arch structure 100*c* are connected by a conducting section 102*b*. In other words, from a bird's point of view, the resistance bar 10 appears to be bow- or W-shaped, and curves many times while stretching from the first end 10*a* to the second end 10*b*. The first current path S1, therefore, passes through the arch structures 100*a* through 100*h* in that order, the arch structures 100*a* through 100*h* acting as a resistance line in series. Given the shape of the resistance bar 10, the physical or visual straight-line distance between the first end 10*a* and the second end 10*b* is less than the length of the first current path S1, which is composed of curves. Meanwhile, not every arch structure needs to be connected with one or a couple of dividing connectors 12. Some of the arch structures may be without a dividing connector 12. Neighboring arch structures may share a dividing connector 12. The dividing connectors 12 may be appear anywhere on the resistance bar 10, though they are often connected to the first and second sides to facilitate engineers' subsequent utilization.

In one example, the resistance bar 10 and the dividing connectors 12 are not structurally distinct. The resistance bar 10 in this case may be defined as wherever the first current path S1 passes through. While the dividing connectors 12 remain open circuits, the current path from the first end 10*a* to the second end 10*b* can only follow the resistance bar 10 without going to the dividing connectors 12. The first current path S1 is the shortest path from the first end 10*a* to the second end 10*b* when the resistance bar 10 is of uniform material; the first current path S1 thus passes through the arch structures 100*a* through 100*h* in that order, and the conducting sections in between.

In one example, the first end 10*a* and the second end 10*b* of the resistance bar 10 are configured to be electrically connected to an external power source, e.g. a power supply. The first end 10*a* may be connected with a first power connector 104, and the second end 10*b* may be connected with a second power connector 106. A current from the external power source may then flow through the entire resistance bar 10 via the power connectors 104 and 106. In this case, the power connectors 104 and 106 may be similar to the dividing connectors 12 in shape and appearance, and may in fact be pressed from the same conducting panel that also makes up the resistance bar 10 and the dividing connectors 12. While the description above implies that the positive and negative ends of the external power source are connected directly to the power connectors 104 and 106, please note that said positive and negative ends may alternatively be connected to any two of the dividing connectors 12 under the remit of the present embodiment.

The resistance bar 10 may be regarded as a monolithic resistance structure when the positive and negative ends of the external power source are connected to the power connectors 104 and 106, between both of which the resistance value is denoted $a_0$. On a piece of uniform material such as the resistance bar 10, the resistance value and the length of a current path are in general directly proportional. Given that the dividing connectors 12 are connected to the resistance bar 10 between the first end 10*a* and the second end 10*b* and that the current flowing through the resistance bar 10 is stable, the voltage observed between any two dividing connectors 12 is directly proportional to the length l of the current path between those two dividing connectors 12. The length l is less than the length of the first current path S1; as a result, the divided voltage output from those two dividing connectors 12 is a proportion of the external power source's voltage V. Thus V can be arbitrarily divided or reduced.

Say a divided voltage is obtained from a dividing connector 12*b*, which is connected to the first side of the second arch structure 100*b*, and another dividing connector 12*d*, which is connected to the second side of the fourth arch structure 100*d*. There exists a second current path S2 and a resistance valued $a_1$ between the dividing connectors 12*b* and 12*d*. The voltage division ratio is $a_1/a_0$, and the divided voltage obtained is $(a_1/a_0)V$. In one example, said division ratio may also be approximated by the ratio of the lengths of the current paths S1 and S2. In the above description, $a_0$ may not be the actual resistance value; it is simply a symbol for illustrating how voltage division works within the voltage dividing resistor 1. A person skilled in the art may freely design the resistance value of the resistance bar 10 by adjusting its material, thickness, or length.

In one example, the voltage dividing resistor 1 undergoes a pre-testing procedure before shipment. Besides retrieving $a_0$, said pre-testing may also be employed to obtain the resistance value between any two of the dividing connectors 12. An engineer may, for instance, choose one of the dividing connectors 12, e.g. the dividing connector 12*b*, as a primary subject, and in turn measure the respective resistance values between the dividing connector 12*b* and every other dividing connectors 12. After all the dividing connectors 12 are exhausted as primary subjects, a table of resistance values emerges, with every value recorded being the resistance between a pair of dividing connectors 12. To obtain a desired divided voltage, an engineer may consult the voltage V of the external power source to compute the division ratio, which multiplied by $a_0$ produces the relevant divided resistance value. Looking up in the table, the engineer may then determine into which two of the dividing connectors 12 he or she should plug to get the divided resistance and hence the divided voltage.

Figure 3:
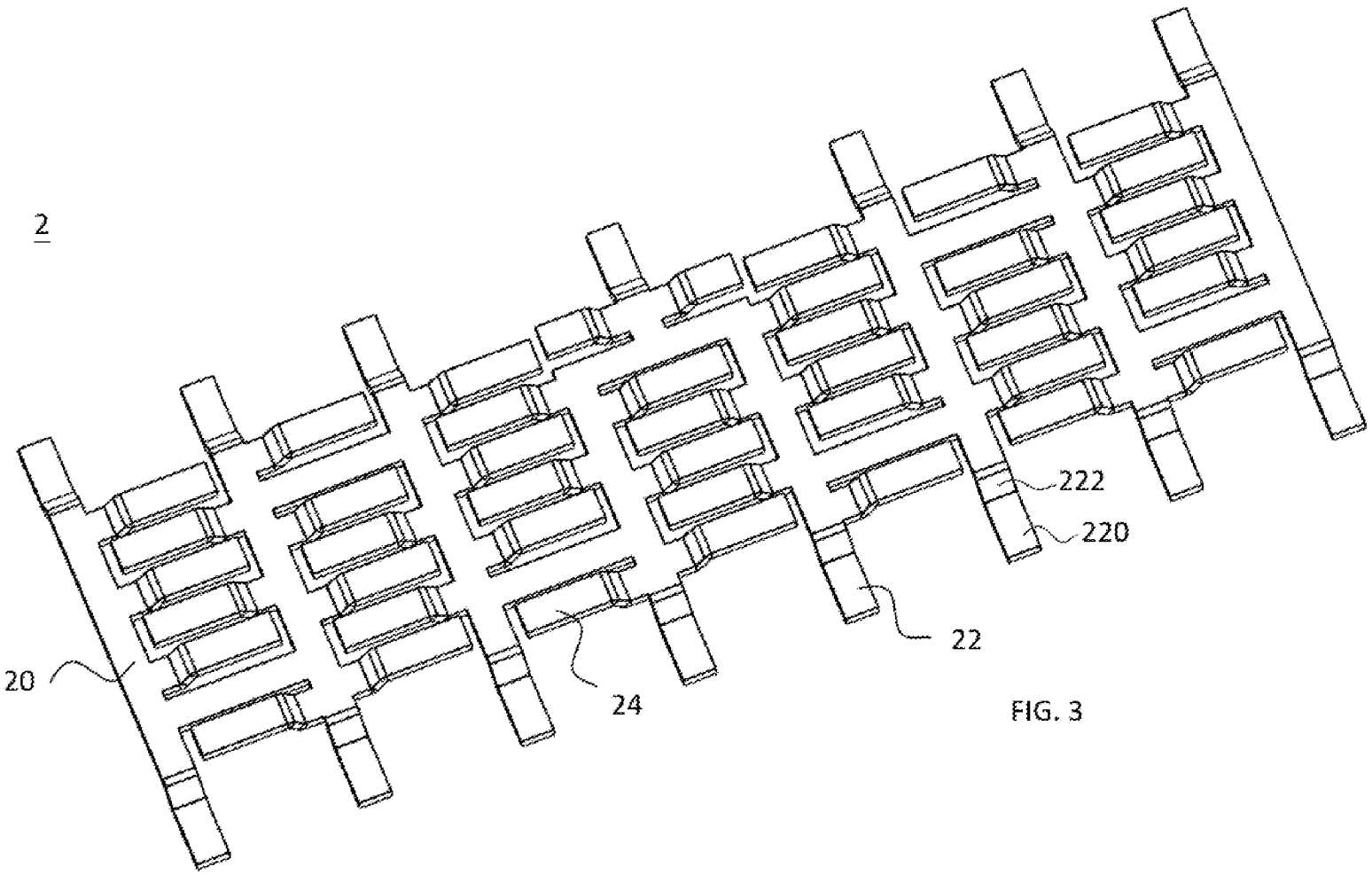
FIG. 3 is a stereogram of a voltage dividing resistor in accordance with another embodiment of the present invention.

A person skilled in the art would understand that, as a current flows through the arch structures 100*a* through 100*h* and the conducting sections, the resistance bar 10 may convert part of the electric energy into heat. It is desirable, then, for the voltage dividing resistor 1 to be enhanced in terms of heat dissipation. The present invention hereby further discloses an embodiment where the voltage dividing resistor has heat dissipation portions. Please refer to FIGS. 3 and 4 in conjunction. According to this embodiment, FIG. 3 is a stereogram of a voltage dividing resistor 2, and FIG. 4 a bird's-eye view of the same. As depicted in the figures, the voltage dividing resistor 2, much like the voltage dividing resistor 1, comprises a resistance bar 20 and a plurality of dividing connectors 22. The dividing connectors 22 are connected to different locations of the resistance bar 20. The resistance bar 20 and the dividing connectors 22 are made from electrically conducting materials.

The shapes of the resistance bar 20 and the dividing connectors 22 are however unlike those in the previous embodiment. The resistance bar 20 as a whole is roughly planar, in contrast with the resistance bar 10, which features very conspicuous arch structures. Note that the dividing connectors 22 include the bent portions 222. One can still regard the voltage dividing resistor 2 as a plurality of arch structures by combining the resistance bar 20 and the dividing connectors 22. In the voltage dividing resistor 2, the resistance bar 20 is less elevated and closer the contact pads 220. The voltage dividing resistor 2 is thus flatter and more applicable to height-constrained circuits.

Figure 4:
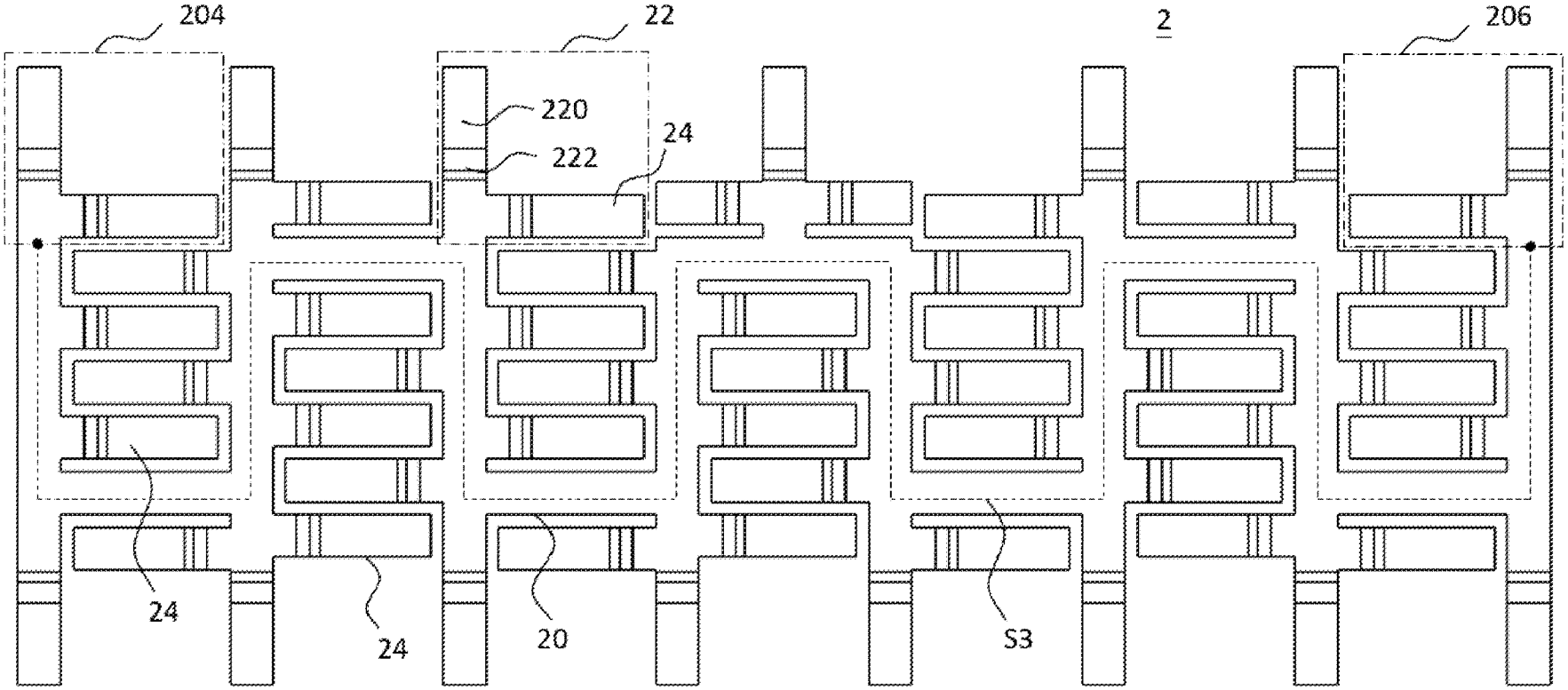
FIG. 4 is a bird's-eye view of a voltage dividing resistor in accordance with another embodiment of the present invention.

Please refer to FIG. 4. At the 'head' and 'tail' ends the resistance bar 20 may be connected with a first power connector 204 and a second power connector 206, respectively. There exists a first current path S3 between the power connectors 204 and 206. Unlike in the previous embodiment, the resistance bar 20 is designed to include a plurality of heat dissipation portions 24, which may also be disposed within the first power connector 204, the second power connector 206, or the dividing connectors 22. In practice, the heat dissipation portions 24, the rest of the resistance bar 20, the power connectors 204 and 206, and the dividing connectors 22 may be pressed from a single piece of conducting panel. Under the remit of the present embodiment, the heat dissipation portions 24 may be of arbitrary shapes and sizes, as long as they do not shorten or interfere with the first current path S3.

Figure 5:
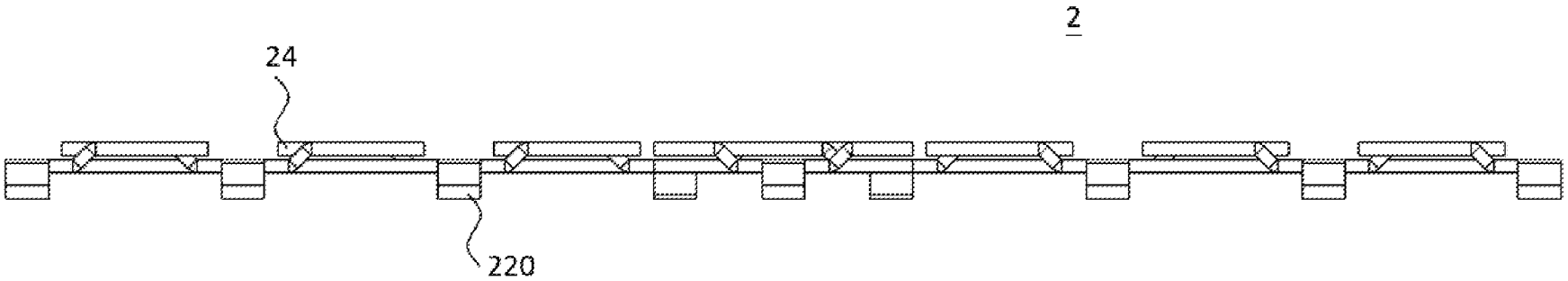
FIG. 5 is a side view of a voltage dividing resistor in accordance with another embodiment of the present invention.

How the heat dissipation portions 24 are bent when being press-made affects their efficiency. Please refer to FIG. 5, a side view of the voltage dividing resistor 2. As shown in FIG. 5, the heat dissipation portions 24 are generally coplanar with one another, but may not be coplanar with the contact pads 220. The heat dissipation portions 24 protrude above the resistance bar 20, while the contact pads 220 are at an elevation lower than the resistance bar 20. The voltage dividing resistor 2, therefore, becomes a hollow structure or openwork whence air brings away heat.

To summarize: The voltage dividing resistor of the present invention comprises a conducting resistance bar that is connected with dividing connectors and may be arranged as a series of arch structures. Engineers can prepare required divided voltages quite easily by connecting to different dividing connectors, whose pairings yield a variety of resistance values. Moreover, the voltage dividing resistor may further comprise heat dissipation portions that prevent overheating and therefore inconsistent resistance values.

What is claimed is:

1. A voltage dividing resistor comprising:

a resistance bar having a first end and a second end and providing a first current path, the first end and the second end configured to be electrically connected to a power source; and a plurality of dividing connectors electrically connected to different locations on the first current path;

wherein the first current path stretches from the first end to the second end along the resistance bar, and the distance between the first end and the second end is less than the length of the first current path;

wherein each of the dividing connectors has a contact pad, the resistance bar not being coplanar with the contact pads of the dividing connectors;

wherein a pair of dividing connectors is chosen from the plurality of dividing connectors, and a divided voltage is obtained from the chosen pair of dividing connectors.

2. The voltage dividing resistor according to claim 1, further comprising:

a first power connector connected to the first end; and a second power connector connected to the second end;

wherein the power source is electrically connected to the first end and the second end through the first power connector and the second power connector, respectively.

3. The voltage dividing resistor according to claim 1, wherein the chosen pair of dividing connectors forms a second current path, and the length of the second current path is less than the length of the first current path.

4. The voltage dividing resistor according to claim 1, wherein each of the dividing connectors has further a bent portion connecting the contact pad with the resistance bar.

5. The voltage dividing resistor according to claim 1, wherein the resistance bar and the dividing connectors are molded monolithically.

6. The voltage dividing resistor according to claim 1, wherein the resistance bar further comprises a plurality of heat dissipation portions stretching out from the resistance bar, and wherein the heat dissipation portions are approximately coplanar with one another and not coplanar with the contact pads of the dividing connectors.

7. A voltage dividing resistor comprising:

M arch structures arranged in order along a first direction and providing a first current path, the first arch structure and the Mth arch structure configured to be connected to a power source; and N dividing connectors electrically connected to the M arch structures;

wherein with regard to the M arch structures there are defined a first side and a second side, and wherein the mth arch structure connects with the (m−1)th at the first side through a first conducting section, and connects with the (m+1)th at the second side through a second conducting section;

wherein each of the dividing connectors has a contact pad not coplanar with the M arch structures;

wherein a pair of dividing connectors is chosen from the N dividing connectors, and a divided voltage is obtained from the chosen pair of dividing connectors;

wherein M and N are natural numbers greater than 2, and m is a natural number greater than 1 and less than M.

8. The voltage dividing resistor according to claim 7, wherein the chosen pair of dividing connectors forms a second current path, and the length of the second current path is less than the length of the first current path.

9. The voltage dividing resistor according to claim 7, wherein each of the dividing connectors has further a bent portion connecting the contact pad with one of the M arch structures.

10. The voltage dividing resistor according to claim 7, wherein the M arch structures and the N dividing connectors are molded monolithically.

11. The voltage dividing resistor according to claim 7, wherein each of the arch structures further comprises at least one heat dissipation portion stretching out from the arch structure.

* * * * *